US006520610B1

(12) United States Patent
Miller

(10) Patent No.: US 6,520,610 B1
(45) Date of Patent: Feb. 18, 2003

(54) PORTABLE STORAGE DEVICE AND TABLE

(76) Inventor: Michael A. Miller, 41 Theresa Blvd., Binghamton, NY (US) 13901

( * ) Notice: Subject to any disclaimer, the term of this patent is extended or adjusted under 35 U.S.C. 154(b) by 0 days.

(21) Appl. No.: 09/974,003

(22) Filed: Oct. 10, 2001

(51) Int. Cl.[7] ..... A47B 83/00
(52) U.S. Cl. ..... 312/277; 312/325
(58) Field of Search ..... 312/291, 293.3, 312/310, 308, 324, 325, 328; 108/138

(56) References Cited

U.S. PATENT DOCUMENTS 344,212 A * 6/1886 Stephens ..... 312/324
1,510,763 A * 10/1924 Canal ..... 312/324
1,883,632 A * 10/1932 Duvall et al. ..... 312/324
1,893,747 A * 1/1933 Kennedy ..... 312/324
2,504,479 A * 4/1950 Wilhoite et al. ..... 312/324
2,723,175 A * 11/1955 Berry ..... 312/324
4,436,353 A 3/1984 Tucker
5,660,310 A 8/1997 LeGrow
5,913,270 A 6/1999 Price

* cited by examiner

*Primary Examiner*—Lanna Mai
*Assistant Examiner*—Jerry A. Anderson
(74) *Attorney, Agent, or Firm*—Donald R. Schoonover

(57) ABSTRACT

A device includes a main container unit and top container units that can be stored inside the main container unit. A lid doubles as a lid and as a table to support food thereon. Legs support the lid on the top container units.

6 Claims, 5 Drawing Sheets

FIG. 7A.
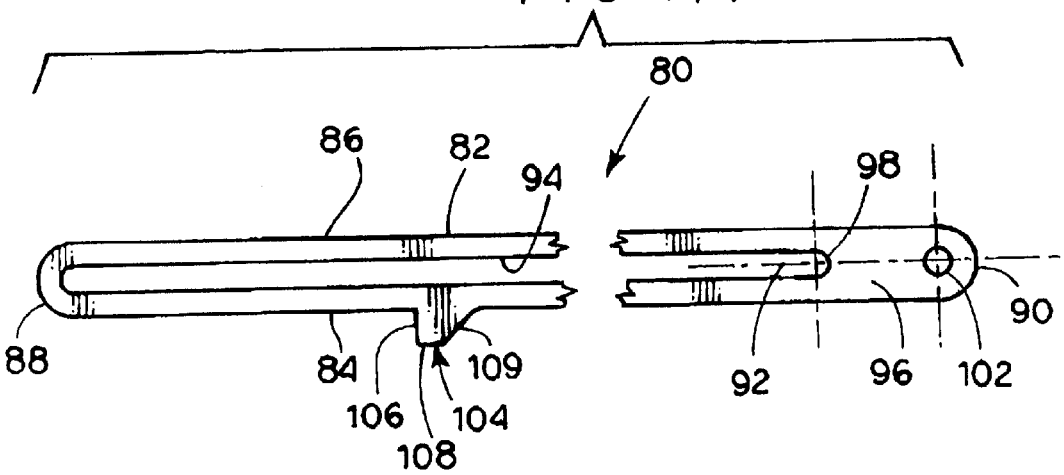
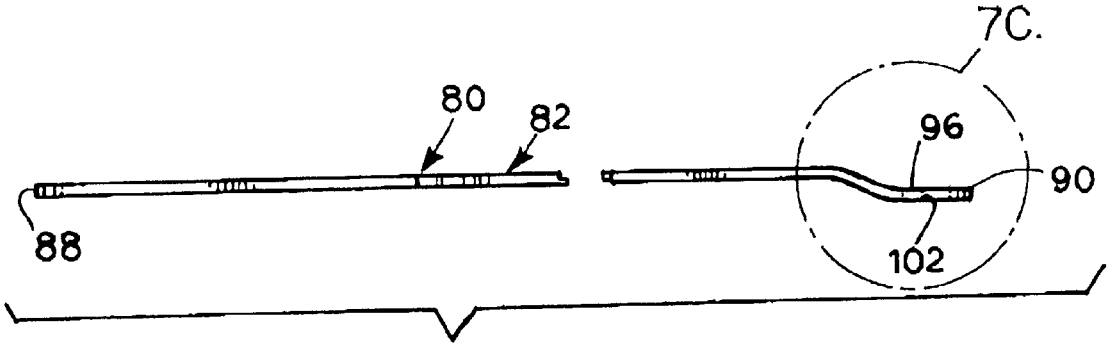
FIG. 7B.
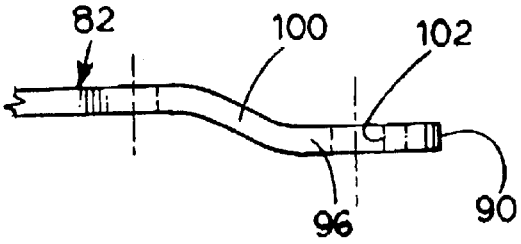
FIG. 7C.

PORTABLE STORAGE DEVICE AND TABLE

BACKGROUND OF THE INVENTION

1. Field of the Invention

The present invention relates to the general art of storage containers, and to the particular field of storage containers which serve multiple purposes.

2. Discussion of the Related Art

Camping, canoeing, tailgating, hiking and the like are becoming ever more popular. Many people engaging in these activities enjoy bringing food along and picnicking. This requires a convenient container for, not only food, but for food preparation and serving utensils as well.

Accordingly, the container art has many examples of containers that can be used to store food in a manner that is convenient for being brought along on some of the above-mentioned activities.

However, most of the known containers are intended primarily for the single purpose of storing and transporting food. However, a problem with such food containers is their lack of storage areas suitable for storing utensils used to prepare and serve food. Such utensils are often merely thrown into the container in a haphazard manner. This often leads to omitting one or more utensils and/or having the utensils lost or unorganized, or even duplicating some utensils while omitting others.

Therefore, there is a need for a container that is suitable for food storage and can also be conveniently used to store and organize utensils used to prepare and serve food and/or consume food.

Still further, it is not always easy to find a convenient and comfortable place to serve and/or consume food during some of the above-mentioned activities. Often, people carry blankets or the like to sit on. This not only requires carrying extra gear, it may not be comfortable.

Therefore, there is a need for a container that is suitable for food storage and can also be conveniently used to store and organize utensils used to prepare and serve food and/or consume food and which is also suitable for serving food.

While the art does contain examples of portable storage and table devices, these devices are often inconvenient and cumbersome to set up and to knock down and generally have many interconnected parts. The many interconnected parts may not always smoothly co-operate with each other in the most efficient manner, and may even jam during set up or knock down, thereby complicating a procedure that should be as easy as possible. Still further, the many parts of some known containers may make the overall unit heavy and cumbersome.

Still further, many interconnected parts may make cleaning the overall unit difficult. Still further, many parts of the unit may take up space that otherwise could be used to store food and/or utensils.

Still further, many of the known storage units do not conveniently store utensils in the unit. This creates the possibility of omitting a needed utensil during the packing procedure.

Therefore, there is a need for a container that is suitable for food storage and can also be conveniently used to store and organize utensils used to prepare and serve food and/or consume food and which efficiently stores utensils between uses.

Still further, many known container units do not provide ready access to utensils stored in the unit when the unit is being used to support food. The unit must be completely emptied and repacked thereby creating the possibility that something will be unavailable when needed, or left behind.

Therefore, there is a need for a container that is suitable for food storage and can also be conveniently used to store and organize utensils used to prepare and serve food and/or consume food and which provides easy access to the storage area when the unit is being used to support food.

PRINCIPAL OBJECTS OF THE INVENTION

It is a main object of the present invention to provide a container that is suitable for food storage and can also be conveniently used to store and organize utensils used to prepare and serve food and/or consume food.

It is another object of the present invention to provide a container that is suitable for food storage and can also be conveniently used to store and organize utensils used to prepare and serve food and/or consume food and which is also suitable for serving food.

It is another object of the present invention to provide a container that is suitable for food storage and can also be conveniently used to store and organize utensils used to prepare and serve food and/or consume food and which also efficiently stores utensils between uses.

It is another object of the present invention to provide a container that is suitable for food storage and can also be conveniently used to store and organize utensils used to prepare and serve food and/or consume food and which provides easy access to the storage area when the unit is being used to support food.

SUMMARY OF THE INVENTION

These, and other, objects are achieved by a portable storage device and table that includes a main container unit and which has top containers that collapse into the main container unit for storage and which has a lid that doubles as a table in a use configuration. The parts of the device are arranged so that storage space is efficiently used and presented in the set up configuration for easy access.

BRIEF DESCRIPTION OF THE DRAWINGS

FIG. 7A is a plan view of a mounting bracket used in the portable storage device and table of the present invention.

FIG. 7B is a side elevational view of the mounting bracket.

FIG. 7C is a view of an end of the mounting bracket.

DETAILED DESCRIPTION OF THE INVENTION

Figure 2:
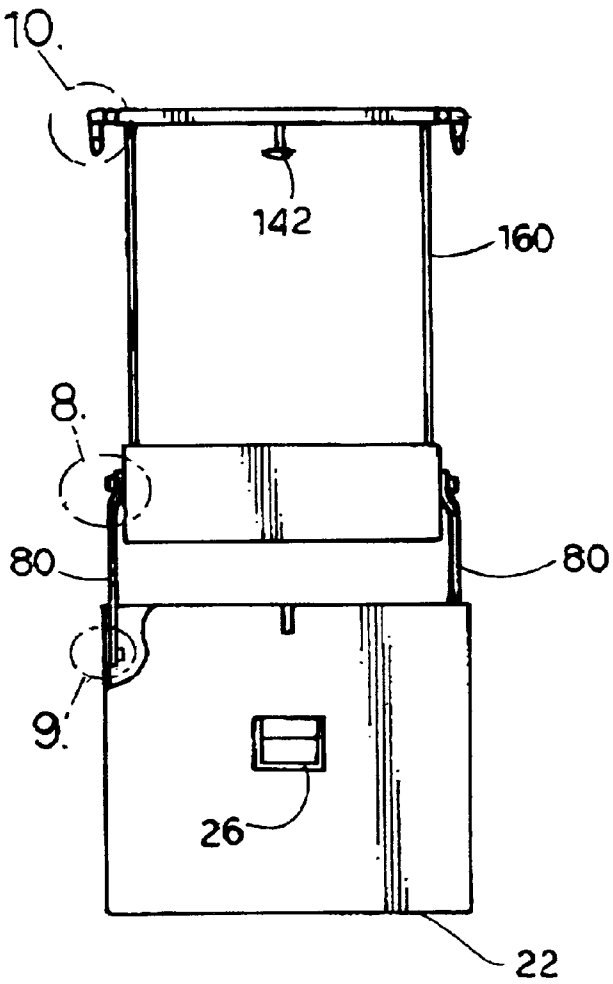
FIG. 2 is an end elevational view of the portable storage device and table of the present invention in the set up or use configuration.

Other objects, features and advantages of the invention will become apparent from a consideration of the following detailed description and the accompanying drawings.

As shown in the figures, the present invention is embodied in a portable storage device and table 10 comprising a main container unit 12 which includes sides 14 and 16, ends 18 and 20, a bottom 22, an open top 24, handles, such as handle 26, an outer surface 28, and an inside surface 30. Food, utensils, and the like are conveniently stored in the main container unit 12, and are easily accessed through the open top 24 for packing or use. As will be understood from this disclosure, the space inside the main container unit 12 is efficiently used so a great deal of material can be placed inside the main container unit 12 along with cooling material or the like.

Main container unit 12 further includes a plurality of sleeves, such as sleeve 40, on inside surface 30 of main container unit 12. Each sleeve 40 has an open top, such as open top 42, located near open top 24 of main container unit 12 and serves a purpose that will be understood from the following discussion. The main container unit 12 further includes a plurality of fastener accommodating holes, such as fastener accommodating hole 43, located near the open top 42 of each sleeve 40.

The main container unit 12 further includes a plurality of stop elements, such as stop element 44, mounted on the inside surface 30 of the main container unit 12. Each stop element 44 is mounted on the inside surface 30 of main container 12 unit near an open top 42 of a sleeve 40.

Device 10 further includes two top containers 50 and 52, which are used to store and dispense items, including food, utensils and the like. Each top container 50, 52 includes sides 54 and 56, ends 58 and 60, a bottom 62, an open top 64, an inside surface 66 and an outside surface 68. As will be understood from the teaching of this disclosure, the top containers 50, 52 are oriented to present the open top 64 thereof in a direction that makes access to the interior of the respective top container 50, 52 easy even when the overall device 10 is in a use or set-up configuration.

Figure 8:
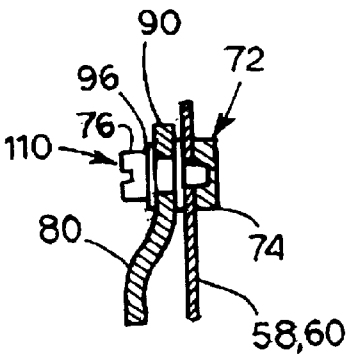
FIG. 8 is a view which shows an enlarged section indicated by line 8—8 in FIG. 2 of a mounting element used to securely attach a mounting bracket to a top container of the portable storage device and table of the present invention.

Each top container 50, 52 further includes a plurality of leg accommodating blocks, such as leg accommodating block 70, fixed to inside surface 66 of the respective top container 50, 52 near open top 64 of the top container. Each top container 50, 52 further includes a plurality of fastener mounts, such as fastener mount 72, in each end 58, 60 of each of each top container 50, 52. In the preferred embodiment, there are four fastener mounts 72 in each container, two in each end 58, 60 of each top container 50, 52. As shown in FIG. 8, each fastener mount 72 includes a washer 74 and a fastener 76.

Device 10 further includes a plurality of mounting brackets, such as mounting bracket 80, connecting each of the top containers 50, 52 to main container unit 12. A mounting bracket 80 is shown in FIGS. 7A–7C and includes an elongate body 82 having side edges 84 and 86, first and second ends 88 and 90, and a longitudinal dimension 92 extending between ends 88 and 90 of elongate body 82. An elongate slot 94 extends along longitudinal dimension 92 of each elongate body 82 from adjacent to first end 80 of elongate body 82 toward second end 90 of the elongate body 82 and is spaced from the second end 90 to define a landing 96 between second end 90 and end 98 of slot 94. Landing 96 is planar as shown in FIG. 7C and is connected to the remainder of body 82 by a connection portion 100 so landing 96 is contained in a plane that is offset from a plane containing the remainder of body 82. A mounting hole 102 is defined through elongate body 82 in landing 96 near second end 90 of the elongate body.

Each mounting bracket further includes a stop element 104 on one side edge of the elongate body 82. Each stop element 104 includes a linear edge 106 extending from the side edge of the elongate body 82, an outer edge 108 spaced from the side edge of the elongate body 82 and a second edge 109 connecting outer edge 108 to the side edge of the elongate body 82 at a location spaced from linear edge 106.

Device 10 further includes a plurality of first fastener units, such as first fastener unit 110, securely attaching the second end 90 of each mounting bracket 80 to a respective top container 50, 52 via an associated one of the fastener mounts 72 in each top container 50, 52. As shown in FIG. 8, the first fastener units 110 include the above-discussed elements 72, 74 and 76.

Figure 5:
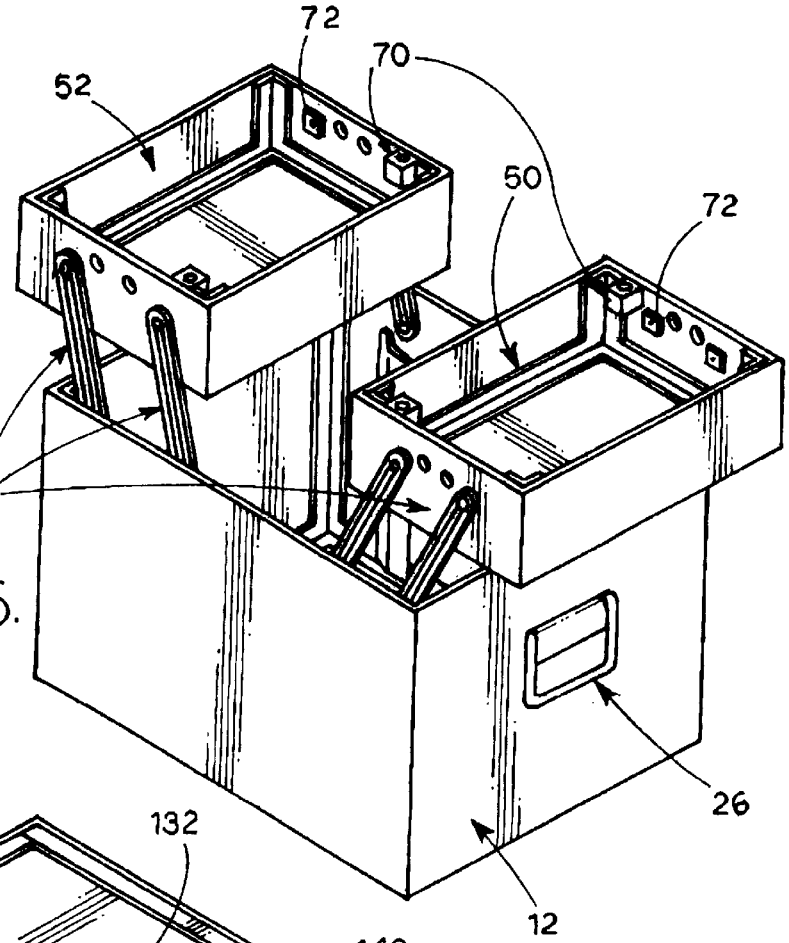
FIG. 5 is a perspective view of the portable storage device and table of the present invention in the set up or use configuration.

Device 10 further includes a plurality of second fastener units, such as second fastener unit 112, slidably attaching an associated one of said mounting brackets 80 to the main container unit 12 and fitting through an associated one of the fastener accommodating holes 43 in the main container unit 12 and through elongate slot 94 in the associated mounting bracket 80 so the associated mounting bracket 80 will slide with respect to the second fastener 112 and with respect to said main container unit 12 so the device 10 can be set up and collapsed with top containers 50, 52 moving between a deployed position shown in FIG. 5 and a stored position inside main container unit 12. Each second fastener unit 112 is positioned with respect to an associated one of sleeves 40 on main container unit 12 so first end 88 of the associated mounting bracket 80 is positioned adjacent to open top 42 of the associated sleeve 40 whereby the associated mounting bracket 80 will slide into the associated sleeve 40 to be in a stored configuration and slide out of the associated sleeve 40 to be in a deployed configuration. In this manner, the brackets 80 are stored inside the sleeves 40 so that moisture or the like does not damage the brackets 80. A stop element 104 on the associated mounting bracket 80 abuts a corresponding stop element 44 on main container unit 12 when the associated mounting bracket 80 is in the deployed configuration to keep the associated mounting bracket 80 in the deployed configuration. The sleeves 40 are large enough to accommodate the brackets 80 as well as the stop elements 104. As can be understood from the foregoing, the linear edge 106 of each stop element 104 engages a corresponding element 44 to support the top containers 50, 52 in the deployed configuration. Thus, the brackets 80 can move to permit the stop elements to clear and engage the elments 44 as required to move the device 10 into the deployed configuration and into the stored configuration.

Figure 9:
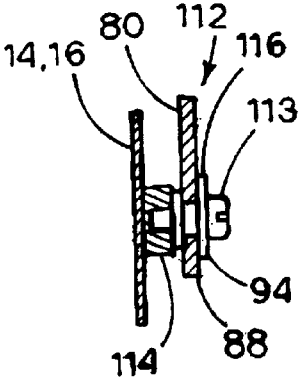
FIG. 9 is a view which shows an enlarged section indicated by line 9—9 in FIG. 2 of a slidable attachment between a mounting bracket and a main container unit of the portable storage device and table of the present invention.

As shown in FIG. 9, the second fastener units 112 include a fastener element 113 extending through slot 94 in bracket 80 and is attached to a mount element 114 on sides 14 and 16 of the main container unit 12. Washers, such as washer 116 are also included in the fastener unit 112.

Figure 10:
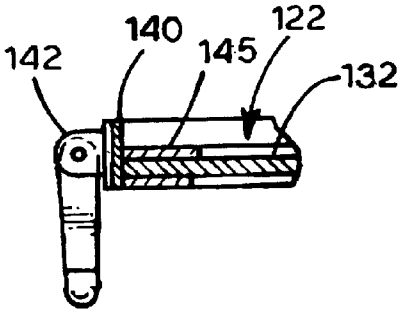
FIG. 10 is a view which shows an enlarged section indicated by line 10—10 in FIG. 2 of a latch for releasably attaching a lid to a main container unit of the portable storage device and table of the present invention.
Figure 6:
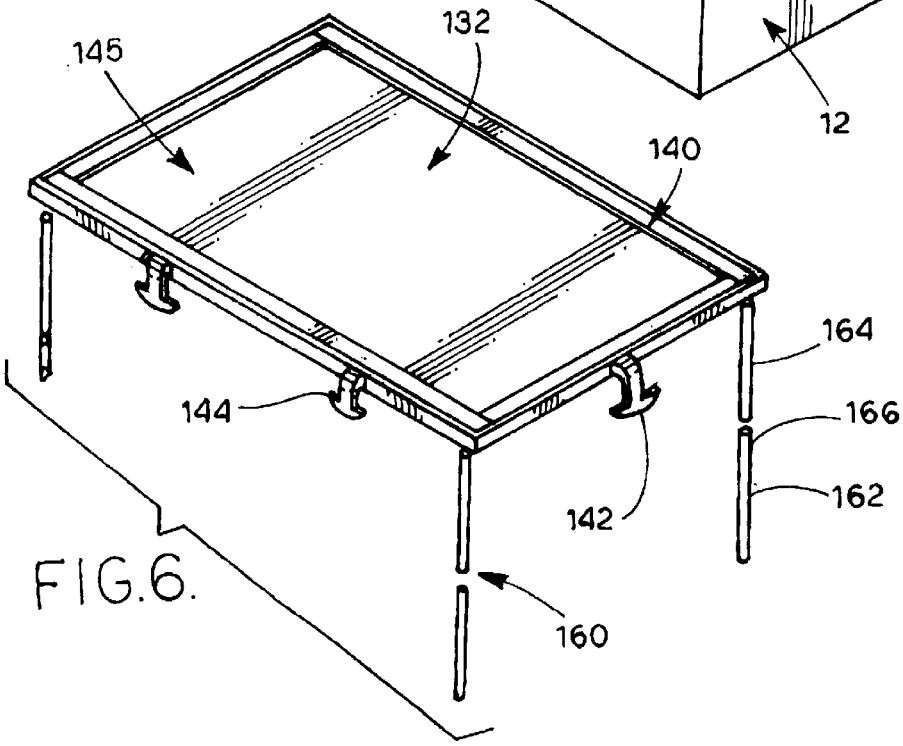
FIG. 6 is a perspective view of a lid/table of the portable storage device and table of the present invention.

Device 10 further includes a lid 120 which includes a planar body 122 with side edges 124 and 126, end edges 128 and 130, a top surface 132, a bottom surface 134, and corners, such as corner 136, at the intersections of the side edges 124, 126 and the end edges 128, 130. A rim 140 includes sections 140' on end edges 128 and 130 and sections 140" on side edges 124 and 126 of planar body 122 of lid 120. Lid 120 further includes latches, such as latch 142, on the end edges 128, 130 and latch 144 on side edges 126 of planar body 122 of lid 120. Latches 142 and 144 lock against the outside surface 28 of the main container unit 12 to lock the lid 120 to the main container unit 12 when the device 10 is closed and are also shown in FIG. 10. As indicated in FIG. 6, a plurality of sponge strips, such as strip 145, are defined in top surface 132 of lid 120. The sponge strips 145 assist a cleaning process of the lid 120 after the lid 120 has been used to support food thereon.

Each top container 50 and 52 has a plurality of leg mounts, such as leg mount 150, one of which is located at each corner of planar body 122.

Figure 1:
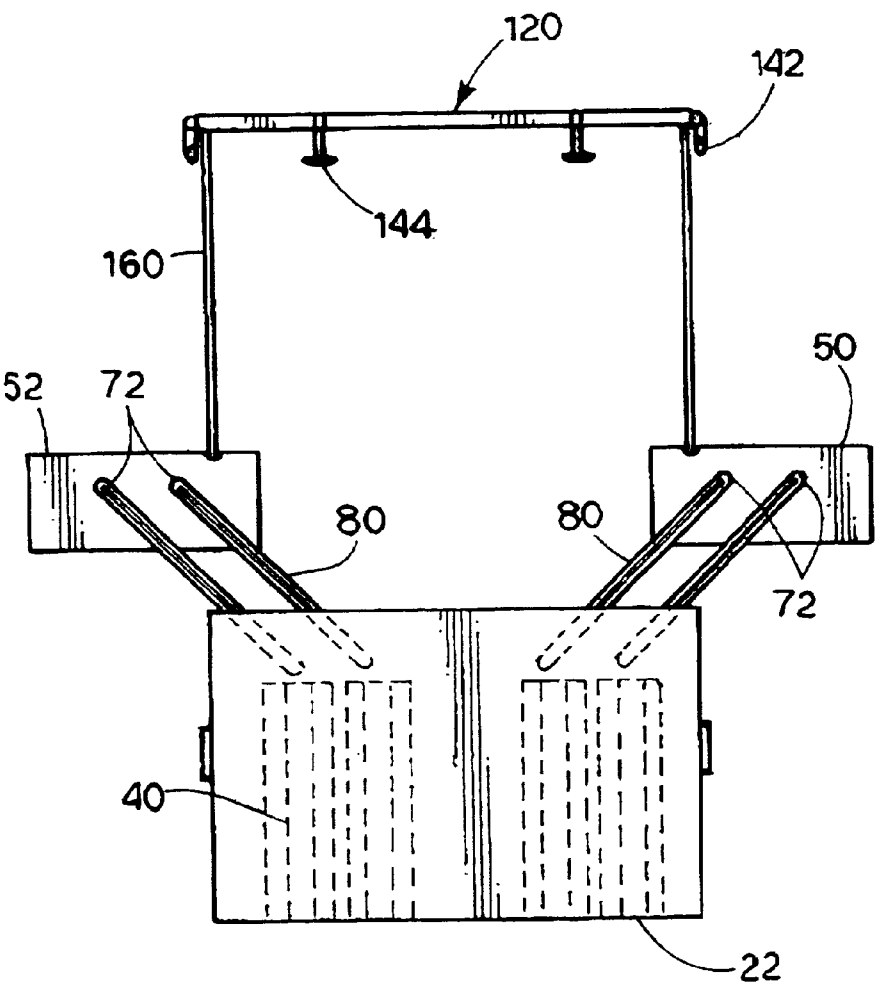
FIG. 1 is a side elevational view of a portable storage device and table of the present invention in a set up or use configuration.
Figure 4:
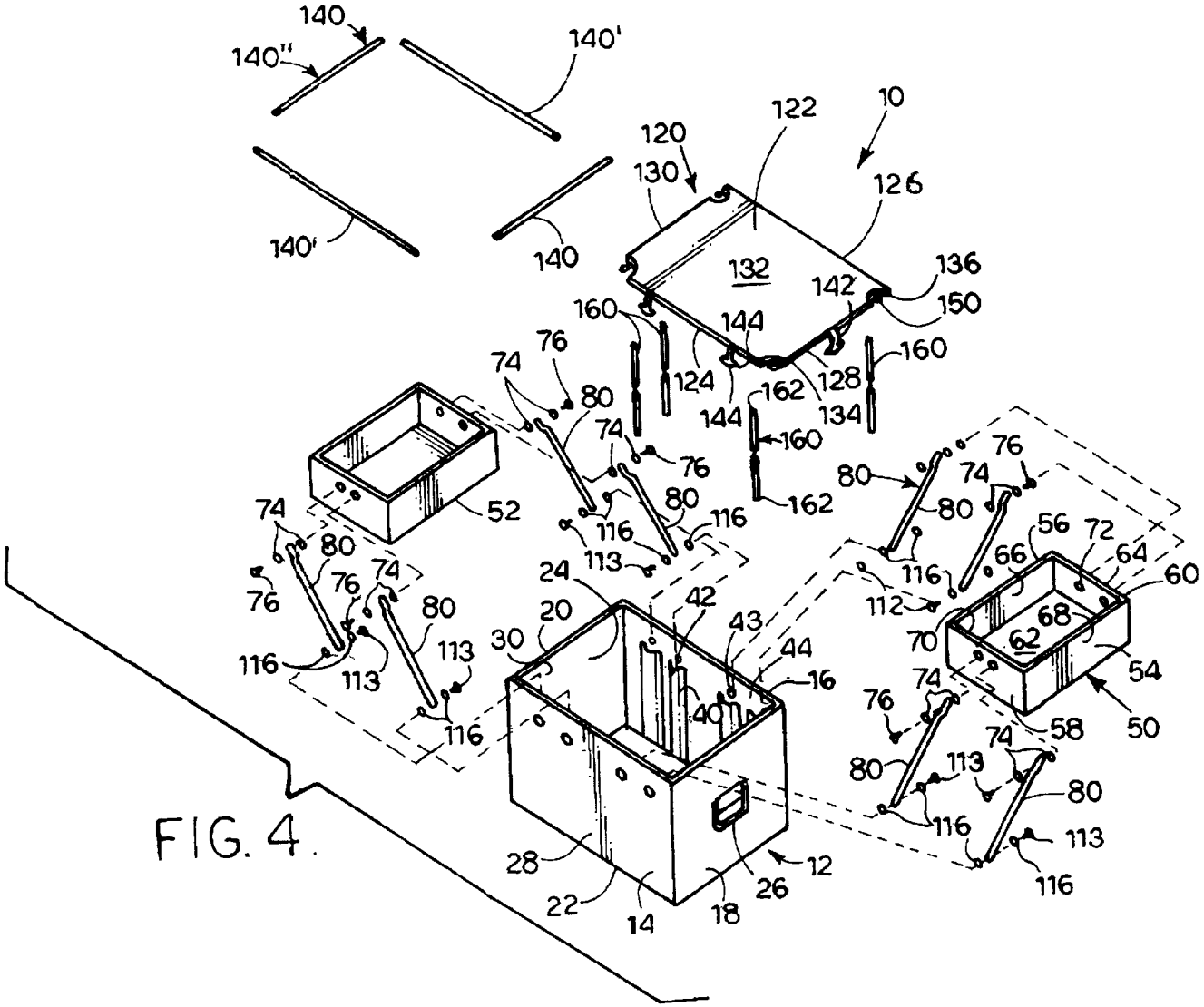
FIG. 4 is an exploded perspective view of the portable storage device and table of the present invention.

Device 10 further includes a plurality of legs, such as leg 160, for supporting the lid 120 on the top containers 50, 52 in a manner shown in FIGS. 1 and 2. Each leg 160 includes one end 169 releasably received in a leg mount 150 in an in-use configuration, and a second end 162 in a leg accommodating block 70 in a respective top container 50, 52 in the in-use configuration. As can be seen in FIG. 4, legs 160 can include a plurality of sections, including sections 164 and 166, which are releasably connected together. In this manner, the legs can assume any of a plurality of lengths to support lid 120 at any of a plurality of heights above top containers 50, 52 as desired.

Figure 3:
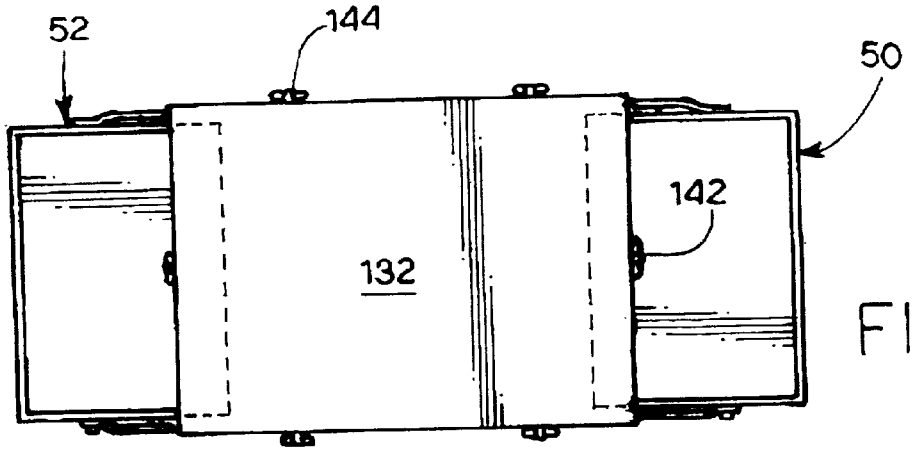
FIG. 3 is a top plan view of the portable storage device and table of the present invention in the set up or use configuration.

As can be understood from FIGS. 3 and 5, the open tops 64 of top containers 50 and 52 and open top 24 of main container unit 12 are oriented to open in the same direction and lid 120 extends over the open tops 64 of top containers 50, 52 and open top 24 of main container unit 12 in the in-use configuration. This orientation of elements permits easy access to the interiors of the top containers 50, 52 and the main container unit 12 even when the lid 120 is in the in-use configuration. Still further, referring to FIGS. 1–3, it can be seen that a portion of the open tops 64 of top containers 50, 52 and open top 24 of main container unit 12 extend beyond lid 120 in the in-use configuration so access to the interior of the top containers and the main container unit is further eased, even when the device is in the in-use configuration. Still further, as can be understood from FIG. 3, when the device 10 is in the in-use configuration, the lid 120 and the top containers 50, 52 protect the inside of the main container unit 12 while still permitting access thereto when desired. The device 10 can be manufactured from suitable aluminum or plastics-type materials if desired.

It is understood that while certain forms of the present invention have been illustrated and described herein, it is not to be limited to the specific forms or arrangements of parts described and shown.

I claim:

1. A portable storage device and table comprising:

a) a main container unit which includes
   (1) sides, ends, a bottom, an open top, handles, an outer surface, and an inside surface,
   (2) a plurality of sleeves on said inside surface of said main container unit, each sleeve having an open top located near said open top of said main container unit,
   (3) a plurality of stop elements, each stop element being mounted on said inside surface of said main container unit near an open top of a sleeve,
   (4) a plurality of fastener-accommodating holes defined through said sides of said main container, each of said fastener-accommodating holes being positioned near an open top of a sleeve, and
   (5) a plurality of handles located on said outside surface of said main container;

b) two top containers, each top container including
   (1) sides, ends, a bottom, an open top, an inside surface and an outside surface,
   (2) a plurality of leg accommodating blocks fixed to said inside surface of each said top container near said open top of said top container, and
   (3) a plurality of fastener mounts in each said end of each said top container;

c) a plurality of mounting brackets connecting each of said top containers to said main container unit, each of said mounting brackets including
   (1) an elongate body having side edges, first and second ends, and a longitudinal dimension extending between said ends of said elongate body,
   (2) an elongate slot extending along said longitudinal dimension of each said elongate body from adjacent to said first end of said elongate body toward said second end of said elongate body,
   (3) said elongate slot having an end spaced from said second end of said elongate body and defining a landing between said end of said elongate slot and said second end of said elongate body, said landing being planar and offset from a plane containing a remainder of said elongate body and being connected to the remainder of said elongate body by a connecting portion,
   (4) a mounting hole through said elongate body near said second end of said elongate body, and
   (5) a stop element on one side edge of said elongate body;

d) a first fastener securely attaching said second end of each said mounting bracket to a respective top container via an associated one of said fastener mounts in each said top container;

e) a second fastener slidably attaching an associated one of said mounting brackets to said main container unit and fitting through an associated one of said fastener accommodating holes in said main container unit and through the elongate slot in said associated mounting bracket so said associated mounting bracket will slide with respect to said second fastener and with respect to said main container unit, said second fastener being positioned with respect to an associated one of said sleeves on said main container unit so said first end of said associated mounting bracket is positioned adjacent to said open end of said associated sleeve whereby said associated mounting bracket will slide into said associated sleeve to be in a stored configuration and slide out of said associated sleeve to be in a deployed configuration, said stop element on said associated mounting bracket abutting a corresponding stop element on said main container unit when said associated mounting bracket is in said deployed configuration to keep said associated mounting bracket in the deployed configuration;

f) a lid which covers said open tops of said top containers and said main container in said stored configuration and is removed from said tops in said in-use configuration, wherein the lid includes (1) a planar body with side edges, end edges, a top surface, a bottom surface, corners at intersections of said side edges and said end edges, (2) a rim on said end edges and on said side edges of said planar body of said lid, (3) latches on said end edges and said side edges of said planar body of said lid, and (4) a leg mount located at each corner of said planar body; and g) a plurality of legs, each leg including (1) one end releasably received in a leg mount in an in-use configuration, and (2) a second end in a leg accommodating block in a respective top container in the in-use configuration.

2. The portable storage device and table as described in claim 1 wherein each said leg includes a plurality of segments releasably connected together in the in-use configuration.

3. The portable storage device and table as described in claim 2 further including a plurality of sponge strips defined in said top surface of said lid.

4. The portable storage device and table as described in claim 3 wherein each of said elements on said mounting brackets includes a linear edge connected to a respective side edge of the body of said mounting bracket, an outer edge spaced from said side edge of said body of said mounting bracket and a second edge connecting said outer edge of said stop element to said side edge of said body of said mounting bracket at a location spaced from said linear edge of said stop element.

5. The portable storage device and table as described in claim 3 wherein said open tops of said top containers and said open top of said main container unit are oriented to open in the same direction and said lid extends over said open tops of said top containers and said open top of said main container unit in the in-use configuration.

6. The portable storage device and table as described in claim 5 wherein a portion of said open tops of said top containers and said open top of said main container unit extend beyond said lid in the in-use configuration.

* * * * *